United States Patent [19]

Schuierer

[11] 4,142,852

[45] Mar. 6, 1979

[54] METHOD FOR DYEING AND FINISHING TEXTILE MATERIAL

[75] Inventor: Manfred Schuierer, Zell, Fed. Rep. of Germany

[73] Assignee: Bruchner Apparatebau GmbH, Erbach, Odenwald, Fed. Rep. of Germany

[21] Appl. No.: 849,305

[22] Filed: Nov. 7, 1977

Related U.S. Application Data

[63] Continuation-in-part of Ser. No. 598,335, Jul. 23, 1975, abandoned.

[30] Foreign Application Priority Data

Jul. 24, 1974 [DE] Fed. Rep. of Germany ..... 2436688

[51] Int. Cl.[2] ..... D06P 3/00; D06P 5/00

[52] U.S. Cl. ..... 8/1 XB; 8/130.1; 8/175; 8/176; 8/178 R

[58] Field of Search ..... 8/1 XB, 175, 130.1, 8/176

[56] References Cited

U.S. PATENT DOCUMENTS

| | | | |
|---|---|---|---|
| 3,512,913 | 5/1970 | Day et al. | 8/4 |
| 3,617,204 | 11/1971 | Pirie | 8/130.1 |
| 3,644,079 | 2/1972 | Smith et al. | 8/4 |
| 3,644,080 | 2/1972 | McCullough et al. | 8/4 |
| 3,669,611 | 6/1972 | Shimauchi et al. | 8/14 |

FOREIGN PATENT DOCUMENTS

| | | |
|---|---|---|
| 2229055 | 12/1972 | Fed. Rep. of Germany. |
| 550724 | 1/1943 | United Kingdom. |
| 684046 | 12/1952 | United Kingdom. |
| 1038205 | 8/1966 | United Kingdom. |

OTHER PUBLICATIONS

Schmidlin, H. U., "Preparation and Dyeing of Synthetic Fibres" (Chapman & Hall), 1963, pp. 25–37.

Moncrieff, R. W., "Man-Made Fibres" (John Wiley), 1975, pp. 940–941.

*Primary Examiner*—A. Lionel Clingman

*Attorney, Agent, or Firm*—Learman & McCulloch

[57] ABSTRACT

This invention relates to a method for the dyeing and finishing of textile carpet material, especially when made of synthetic fibres, and wherein the dyeing and fixing of the dye takes place at a reduced temperature, in particular at room temperature.

11 Claims, No Drawings

METHOD FOR DYEING AND FINISHING TEXTILE MATERIAL

RELATED APPLICATION

This application is a continuation-in-part of application Ser. No. 598,335, filed July 23, 1975, now abandoned.

While hitherto synthetic fibres have only been dyed by using relatively high temperatures, for cotton and wool there is already a method known wherein the dye is fixed at room temperature. But if one attempts to use such a method for textile material made of synthetic fibres, such as polyamide, it is found that the unavoidable differences in the temperature effects of the preceding processes of manufacturing the fibres and yarns lead to differences in affinity and hence cause different degrees of fixing. Thus the textile material easily becomes streaky with this type of cold fixing method.

A further disadvantage occuring with this cold fixing is that following the cold fixing the synthetic fibres, texturized yarns do not fully develop their textile properties, e.g. bulkiness, crease recovery and the like.

On the other hand cold fixing is highly desirable, not only from the energy-saving aspect, but also from the absence of the waste water problem, provided the process is suitable.

The invention is therefore based on the problem of developing a method which enables the dyeing and fixing of textile material made of synthetic fibres to be carried out at a reduced temperature, but with all the textile properties of the material nevertheless fully developed.

According to the invention this problem is solved in that before use of the dye or finishing liquor the textile material is subjected to a stabilizing or leveling heat treatment at an elevated temperature sufficient to relieve stresses in the fibers and exceeding that at which the material is dyed and fixed.

An adequate heat treatment of this type compensates for the thermal differences in the fibres, arising from their "previous history", and brings about uniform affinity. In addition the heat treatment brings the fibres into a thermoplastic range wherein stresses arising during manufacture are released, which improves the bulkiness and other properties of the textile fibres.

This heat treatment carried out for leveling in accordance with the invention need only be relatively brief, e.g., the material may be heated to an elevated temperature of between 90° C. and 150° C. for a period of between 15 seconds and 30 minutes, and in any case considerably shorter than with hot fixing. Also if hot water is used as the heat treatment medium, it can be used a number of times without purification. In addition a liquid or gaseous heating medium can be used for the heat treatment in accordance with the invention.

The method as provided by the invention is particularly effective if the textile material is in the form of a multi-layer coil during the fixing process. With the material in this form it is in fact important for it to be previously stabilized by the heat treatment and hence made unsusceptible to flattening and deformation.

In accordance with the invention the heat treatment may be effected by a hot gaseous medium, especially water vapour or hot air. This mode of operation is especially economical in energy, since there is no auxiliary fluid to be heated, and also no replacement is needed since no soiling materials are released.

The heat treatment in accordance with the invention may be carried out discontinuously in a closed pressurized container, using water vapour, preferably under pressure, as the medium for heat treatment.

However a continuous operating system is also possible, preferably using water vapour (saturated vapour or superheated steam) or hot air as the heat treatment medium.

Following the heating for stress relieving of the fibres, the material is immediately cooled to room temperature by passing room temperature air through the material. The material then is subjected to dyeing and fixing, both at room temperature.

The method as provided by the invention has especial significance in the dyeing and finishing of pile fabrics, especially carpets made of polyamide fibres. With this textile material it is particularly important for the heat treatment to provide extensive non-susceptibility to flattening and deformation of the pile fabric.

For application of the method in accordance with the invention to pile fabrics it is also advantageous for the dye or finishing liquor to be poured on the tufted pile, by means of spray nozzles, for example, so avoiding any unnecessary flattening. In addition, pouring on of the dye avoids wasting of dye by coloring the carpet backing, e.g. jute, which is not seen when the carpet is in use.

For the dyeing and finishing of textile material subjected to heat treatment in accordance with the invention, a relatively small amount of liquor is sufficient; with coiled or looped fabric for instance a quantity between 80 and 150% of the fabric weight, and for velour fabric a quantity between 120% and 300% of the fabric weight.

The following examples will serve for further explanation of the invention:

EXAMPLE 1

Carpet fabric comprising a backing of jute and pile of polyamide fibres is fed to an autoclave wherein the fabric remains for three minutes. The autoclave is operated with steam at 105° C. After leaving the autoclave the fabric immediately (e.g., within five seconds) passes through a zone utilized for cooling, during which room temperature air is sucked through the material. Following cooling to room temperature the fabric is passed through a dyeing chamber and the pile is sprayed with an aqueous dye stuff solution, either acid or dispersion, of about 6 pH. The dyeing solution is maintained at room temperature and comprises about 250% of the weight of the carpet material, e.g., about 2.5 l./kg. of material. Following dyeing the material is coiled for fixing and is maintained at room temperature for about 16 hours.

EXAMPLE 2

The process of Example 1 was followed except that the material was subjected to steam at about 150° C. for about 3 minutes to relieve stress in the fibres, and thereafter was cooled within about 15 seconds to room temperature. The material was then dyed as before and left without coiling for about 24 hours at room temperature for fixing.

I claim:

1. A method of dyeing and fixing textile material made from polyamide fibers comprising the steps of first heating said material to an elevated temperature of at least about 90° C. sufficient to relieve stresses in said fibers; cooling said material to substantially room temperature directly following said heating step; applying to said cooled material a dye at substantially room temperature; and fixing said dye substantially at room temperature.

2. A method as in claim 1, characterized in that the duration of the heating is between 3 and 30 minutes.

3. A method as in claim 1, characterized in that the textile material is formed into a multi-layer coil prior to fixing.

4. A method as in claim 1, characterized in that the heating is effected by a hot gaseous medium.

5. A method as in claim 1, characterized in that the heating is a discontinuous operation in a pressurized closed container, using water vapour, preferably under elevated pressure.

6. A method as in claim 1, characterized in that the heating is a continuous operation, using water vapour.

7. A method as in claim 1, characterized in that the textile material comprises polyamide fiber pile.

8. A method as in claim 1, characterized in that dyeing is effected by pouring dye liquor on said material.

9. A method as in claim 1, characterized in that dyeing is effected by applying to said material a dye liquor in the amount of between 80% and 150% of the weight of material.

10. A method as in claim 1, characterized in that dyeing is effected by applying to said material a dye liquor in the amount of between 120% and 300% of the weight of material.

11. A method of dyeing and fixing polyamide fibre pile material comprising the steps of first heating said material to an elevated temperature of at least about 90° C. and sufficient to relieve stresses in the fibres; cooling said material to substantially room temperature directly following said heating step; applying to said cooled material a dye at substantially room temperature; coiling said material into a multi-layer coil following the application of said dye; and fixing said dye substantially at room temperature while said material remains in said coil.

* * * * *